US009448035B2

(12) United States Patent
Wilson

(10) Patent No.: US 9,448,035 B2
(45) Date of Patent: Sep. 20, 2016

(54) FOLDABLE FIREARM SIGHT ASSEMBLY INCLUDING A LEAF SPRING

(71) Applicant: Sig Sauer, Inc., Newington, NH (US)

(72) Inventor: John Wilson, East Waterboro, ME (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 14/609,731

(22) Filed: Jan. 30, 2015

(65) Prior Publication Data

US 2015/0369564 A1 Dec. 24, 2015

Related U.S. Application Data

(60) Provisional application No. 61/934,249, filed on Jan. 31, 2014.

(51) Int. Cl.

| | |
|---|---|
| ***F41G 1/16*** | (2006.01) |
| ***F41G 1/04*** | (2006.01) |
| ***F41G 11/00*** | (2006.01) |
| *F41G 1/17* | (2006.01) |

(52) U.S. Cl.
CPC ..... *F41G 1/04* (2013.01); *F41G 11/003* (2013.01); *F41G 1/17* (2013.01)

(58) Field of Classification Search
CPC ..... F41G 1/16; F41G 1/17
USPC ..... 42/148, 138, 140, 147, 128, 111
See application file for complete search history.

(56) References Cited

U.S. PATENT DOCUMENTS

| | | | | |
|---|---|---|---|---|
| 804,805 | A * | 11/1905 | Garrison | F41G 1/065 42/147 |
| 878,857 | A * | 2/1908 | Bevier | F41G 1/28 42/136 |
| 1,089,009 | A * | 3/1914 | Porter | F41G 1/02 42/148 |
| 2,283,692 | A | 5/1942 | Paldani | |
| 5,533,292 | A | 7/1996 | Swan | |
| 6,722,075 | B1 * | 4/2004 | Gabaldon | F41G 1/01 42/136 |
| 6,732,467 | B1 | 5/2004 | Luth | |
| 6,779,290 | B1 | 8/2004 | Houtsma | |
| 7,296,376 | B2 | 11/2007 | Kidd | |
| 7,730,655 | B2 | 6/2010 | Spuhr | |
| 7,882,655 | B1 * | 2/2011 | Nesseth | F41G 1/12 42/111 |
| 7,908,782 | B1 | 3/2011 | LaRue | |
| 7,946,074 | B2 | 5/2011 | Nemec | |
| 8,015,744 | B1 * | 9/2011 | Swan | F41G 1/065 42/133 |
| 8,196,333 | B2 | 6/2012 | Hopkins et al. | |
| 2006/0207157 | A1 * | 9/2006 | Keng | F41G 1/32 42/132 |

* cited by examiner

*Primary Examiner* — Reginald Tillman, Jr.
(74) *Attorney, Agent, or Firm* — Finch & Maloney PLLC

(57) ABSTRACT

A foldable firearm sight assembly including a leaf spring is disclosed. The disclosed assembly may include a base, a sight arm, and a leaf spring. The base of the sight assembly may be configured to attach to a firearm rail using, for example, a clamp bracket and a clamp bolt. The sight arm may be rotationally coupled to the base, and the leaf spring may be positioned between the base and the sight arm. When installed in the sight assembly, the leaf spring may be deflected and may apply a biasing force to the sight arm, causing the sight arm to favor either a deployed or stowed (undeployed) position. The sight arm may be lockable in stowed and/or deployed positions using a tooth and aperture configuration. In such lockable cases, the arm may be unlocked/released by manually depressing an end of leaf spring.

21 Claims, 9 Drawing Sheets

FOLDABLE FIREARM SIGHT ASSEMBLY INCLUDING A LEAF SPRING

CROSS-REFERENCE TO RELATED APPLICATION

This application claims the benefit of U.S. Provisional Patent Application No. 61/934,249, filed on Jan. 31, 2014, which is herein incorporated by reference in its entirety.

FIELD OF THE DISCLOSURE

The disclosure relates to firearms and more particularly to a firearm sight assembly.

BACKGROUND

Firearm design involves a number of non-trivial challenges, including the design of firearm sight mechanisms. Firearm aiming devices include optical scopes, lasers, and traditional rear and front alignment sights (sometimes referred to as iron sights). Considerations related to the design of a firearm sight may include size, functionality, and method of installation on a firearm.

SUMMARY

One example embodiment of the present invention provides a firearm sight assembly including: a base configured to attach to a firearm rail; a sight arm rotationally coupled to the base; and a leaf spring positioned between the base and the sight arm; wherein the leaf spring provides a biasing force to the sight arm in a direction substantially away from the base; and wherein the leaf spring defines an aperture and the sight arm includes at least one tooth configured to insert into the leaf spring aperture to lock the sight arm in a stowed and/or deployed position. In some cases, the leaf spring acts as a detent to resist the rotation of the sight arm. In some cases, the sight arm includes trunnions configured to nest in pockets on sides of the base. In some cases, the base includes hubs configured to nest in pockets in the sides of the sight arm. In some cases, the leaf spring extends beyond at least one end of the sight arm to allow an end of the leaf spring to be manually depressed to unlock the sight arm when locked in the stowed and/or deployed position. In some cases, the leaf spring includes tabs on an end of the leaf spring, the tabs configured to be placed in and provide force against pockets in the base. In some cases, a portion of the base acts as a fulcrum for the leaf spring. In some cases, the maximum overall height of the assembly is less than 5 cm when in the deployed position. In some cases, the overall length of the assembly is less than 120% of the overall height of the sight arm. In some cases, the sight arm includes a removable sight post. In some cases, the sight arm and/or the base include rotational stops to resist rotation of the sight arm relative to the base in at least one direction once the sight arm is in the deployed position.

Another example embodiment of the present invention provides a foldable firearm sight assembly including: a base configured to attach to a firearm rail; a clamp bracket configured to fix the base to the firearm rail; a clamp bolt connecting the clamp bracket to the base; a sight arm rotationally coupled to the base at a pivot point; and a leaf spring positioned between the base and the sight arm; wherein the sight arm and leaf spring include locking means configured to lock the sight arm in a stowed and/or deployed position. In some cases, the locking means include at least one aperture defined in one of the sight arm and the leaf spring and a tooth on the other of the sight arm and the leaf spring, the tooth configured to insert into the at least one aperture when the sight arm is in a stowed and/or deployed position. In some cases, the clamp bolt acts as a fulcrum for the leaf spring. In some cases, the leaf spring provides a biasing force to the sight arm. In some cases, the leaf spring extends beyond at least one end of the sight arm to allow an end of the leaf spring to be manually depressed to unlock the sight arm when locked in the stowed and/or deployed position.

Another example embodiment of the present invention provides a method of unlocking a firearm sight assembly, the firearm sight assembly including a base, a sight arm rotationally coupled to the base, and a leaf spring positioned between the base and the sight arm, wherein the sight arm and leaf spring are configured to lock the sight arm in a stowed and/or deployed position, the method including: depressing an end of the leaf spring to clear the sight arm from the leaf spring; pivoting the sight arm to a new position; and releasing the end of the leaf spring. In some cases, the end of the leaf spring extends beyond at least one end of the sight arm. In some cases, the end of the leaf spring extends beyond at least one end of the base. In some cases, the method includes locking means including at least one aperture defined in one of the sight arm and the leaf spring and a tooth on the other of the sight arm and the leaf spring, the tooth configured to insert into the at least one aperture when the sight arm is in a stowed and/or deployed position. In some cases, the base is configured to attach to a firearm rail. In some cases, the base is integral with at least one of a firearm and a component removably attached to the firearm, such as a firearm rail. In some such cases, the base may be integral with the upper receiver of the firearm, for example.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1A:
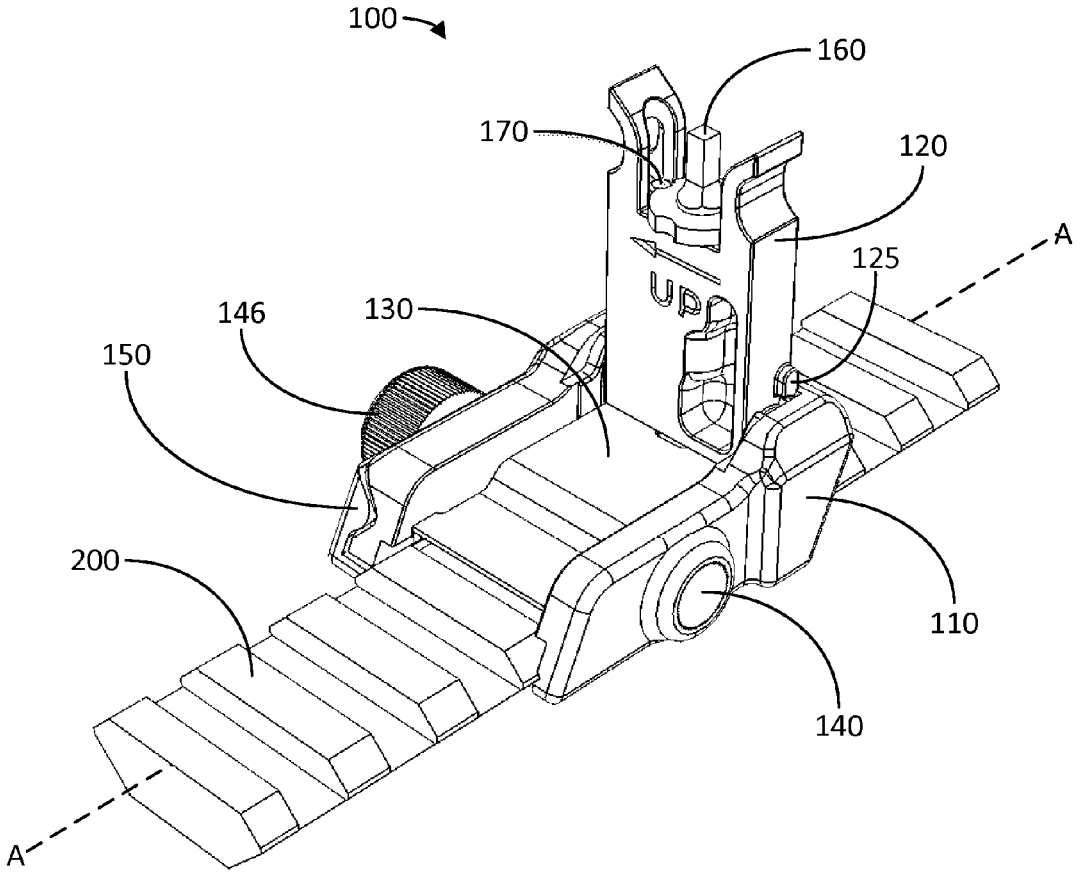
FIGS. 1A and 1B illustrate front perspective views of a sight assembly attached to a firearm rail shown in a deployed and stowed position, respectively, in accordance with an embodiment of the present disclosure.

These and other features of the present embodiments will be understood better by reading the following detailed description, taken together with the figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the claimed invention to the specific configurations shown. In short, the figures are provided merely to show example structures.

DETAILED DESCRIPTION

A foldable firearm sight assembly including a leaf spring is disclosed. The disclosed assembly may include a base, a sight arm, and a leaf spring. The base of the sight assembly may be configured to attach to a firearm rail using, for example, a clamp bracket and a clamp bolt (connecting the clamp bracket to the base). The sight arm may be rotationally coupled to the base, and the leaf spring may be positioned between the base and the sight arm. When installed in the sight assembly, the leaf spring may be deflected and may apply a biasing force to the sight arm (e.g., in an upward direction away from the base), causing the sight arm to favor either a deployed or stowed (undeployed) position. The sight arm may be lockable in stowed and/or deployed positions using a tooth and aperture configuration. In such lockable cases, the arm may be unlocked/released by manually depressing an end of leaf spring. In some instances, the sight assembly may be used as a back-up sight, because of its folding ability and compact nature. Numerous configurations and variations will be apparent in light of this disclosure.

General Overview

As previously indicated, there are a number of non-trivial issues related to the design of a firearm sight mechanism. For example, such issues may relate to the size or robustness of the mechanism, the functionality of the sight mechanism (e.g., relating to stowing the mechanism or customizing the sight), and the method of installation of the mechanism onto a firearm. Whether the sight mechanism is intended to be a primary or back-up sight for a firearm may also be an important consideration for its design. With the recent widespread acceptance of optical primary sights, the need for back-up sights (e.g., iron sights) has increased, especially for use with complex or vulnerable primary sights. It may be advantageous for back-up sight mechanisms to be compact/unobtrusive, light, stowable, durable, customizable (e.g., having the ability to change the reticle/sight), and easily installed on a firearm.

Thus, and in accordance with a set of embodiments of the present disclosure, a foldable firearm sight assembly including a leaf spring is disclosed. In some embodiments, the disclosed sight assembly may include a base configured to be attached to a firearm rail, such as a Picatinny rail (also known as a MIL-STD-1913 rail, STANAG 2324 rail, tactical rail, or M1913). The base of the sight assembly may be configured to attach to the firearm rail in various ways, such as using a clamp bracket and a clamp bolt to connect the clamp bracket to the base and to help secure the base to the firearm rail. Such a system may also help with the overall assembly of the sight mechanism by securing other components of the sight assembly together, as will be apparent in light of this disclosure. The sight assembly may also include a sight arm rotationally coupled to the base and a leaf spring positioned between the base and the sight arm. The leaf spring may be deflected when positioned between the base and the sight arm, causing the leaf spring to provide a biasing force against the bottom of the sight arm. The biasing force may be applied against the sight arm in both deployed and stowed/undeployed positions, as well as when the sight arm is being folded. One or more parts of the sight assembly may act as a fulcrum for the leaf spring, such as a portion of the base or the clamp bolt (in embodiments where a clamp bolt is used to connect the base to the firearm rail).

As will be apparent in light of this disclosure, the leaf spring of the sight assembly may be used to retain the sight arm and base together in a hinged assembly, provide a biasing force against the sight arm to cause the sight arm to favor either a stowed or deployed position, provide a positional reference for the sight arm when in the deployed position, lock the sight arm in the stowed and/or deployed position, and/or provide a way for releasing the sight arm from a locked position. As will also be apparent, the sight assembly may be configured such that the sight arm can be folded or rotated between stowed and deployed positions. Therefore, the sight assembly as variously described herein can be used as a back-up sight for a firearm to be deployed only when desired (e.g., when a primary firearm sight fails). In some embodiments, the biasing force provided by the leaf spring on the sight arm may cause the sight arm to prefer or favor stowed and/or deployed positions. In such embodiments, the properties of the leaf spring (e.g., the material, the spring constant, the moment arm, the pre-deflection/compression on the spring in the assembly, etc.) may be customized as desired to adjust the overall properties of the sight assembly, such as the force needed to switch between stowed and a deployed positions. For example, in some such embodiments, the biasing force that the leaf spring applies on the sight arm may be great enough to prevent collapse of the sight arm when bumped (or otherwise unintentionally hit), but low enough for a user to manually knock it down. In some embodiments, the sight arm may be locked into the deployed and/or stowed position, for example, using a tooth on the sight arm and an aperture in the leaf spring, as will be discussed in more detail below.

As will be appreciated in light of this disclosure, some embodiments may realize benefits or advantages as compared to existing approaches. For instance, in some embodiments, the sight arm and leaf spring may include locking means configured to lock the sight arm in a stowed and/or deployed position. For example, the sight arm may include one or more teeth configured to insert into an aperture defined in the leaf spring to lock the sight arm in a deployed and/or stowed position. At least a portion of the tooth may have a cross-sectional profile similar or equivalent to the profile of the aperture, reducing any lateral movement when the tooth is seated in the aperture. The tooth may be tapered so that it can more easily find the aperture and may increase in cross section from proximal to distal end so that when inserted, the tooth extends into the aperture until the cross section of the tooth fills the cross section of the leaf spring. In another example embodiment, the leaf spring may include a tooth configured to insert into one or more apertures defined in the sight arm to lock the sight arm in a deployed and/or stowed position. In such example embodiments, the arm may be unlocked/released from a locked position by depressing an end of the leaf spring (e.g., an end that extends beyond the sight arm and/or base) to remove the tooth from the aperture and allow the sight arm to be rotated to a desired position. Further, in some such example embodiments, the leaf spring may be anchored to the base, as will be apparent in light of this disclosure. Therefore, the means for locking the sight arm may be integral to the sight arm and leaf spring, in some embodiments, and thus reduce the need for locking mechanisms that are independent from the primary sight assembly components (e.g., the base, sight arm, and leaf spring). Such embodiments may provide the advantage of reducing the number of parts, added cost, complexity, and bulk of the sight assembly. In addition, the leaf spring may provide a robust positional reference for the deployed arm (e.g., by providing horizontal and vertical alignment), thereby reducing or eliminating at least one source of sighting error that would otherwise be found in folding sights.

Some embodiments may utilize small form factor components constructed from materials which are lightweight, resilient, inexpensive, etc. In some such embodiments, minimal mass, bulk, and/or height may be added to the host firearm, thereby helping to maintain a reliable, lightweight, and compact firearm. For example, as the height dimension of the sight arm approaches a minimum practical length for the leaf spring to still function, a minimal height and length for the sight can be achieved. Further, by the efficient use and compact arrangement of the components of the sight assembly as variously described herein, the sight assembly can allow for a smaller back-up sight than other back-up sights, which provides greater flexibility in use. This compact form can help to avoid interference with primary sights in instances where the sight assembly is used as a back-up sight, and facilitates attaching the sight assembly to short rails (e.g., short gas-block-mounted rails). In addition, the sight assembly may be used as a front and/or a rear back-up sight, as will be discussed in more detail below. In some embodiments, the front sight may include a sight post and the rear sight may include a sight notch or aperture from which to view the sight post for the purpose of aligning a firearm with a target. Thus, in some embodiments, a pair of sight assemblies may be included, where one of the sight assemblies operates as the front sight and the other sight assembly operates as the rear sight.

Some embodiments may have a small number of parts or components (e.g., fewer than four, five, or six components, for instance), as previously described, and the components may be simple parts that are easy to manufacture or construct. Further, installation of the sight assembly components on a firearm frame may be simple and intuitive. Also, in some instances, a reduction in cost (e.g., of production, of repair, of replacement, etc.) may be realized. In some cases, and in accordance with some embodiments, a sight assembly as variously described herein can be configured, for example, as: (1) a partially/completely assembled sight assembly unit; and/or (2) a kit or other collection of discrete components (e.g., a base, sight arm, a leaf spring, etc.) which may be configured to assemble as described herein. Numerous configurations and variations will be apparent in light of this disclosure.

Structure and Operation

Figure 1B:
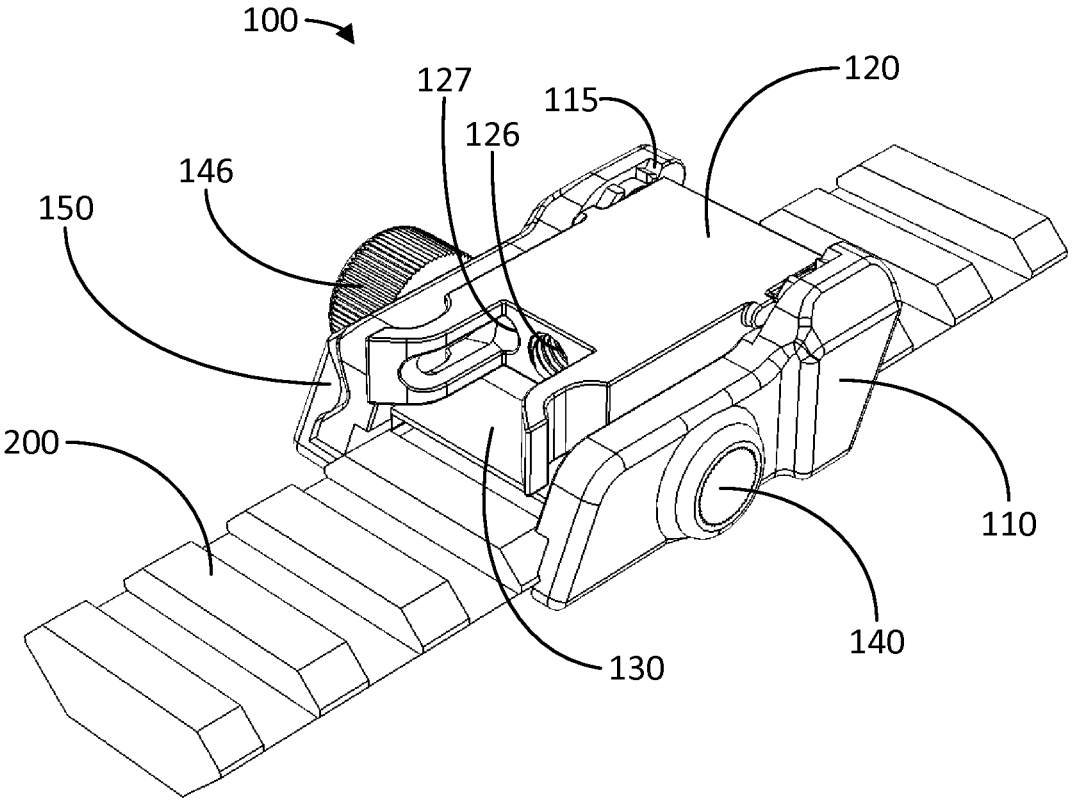
Figure 2:
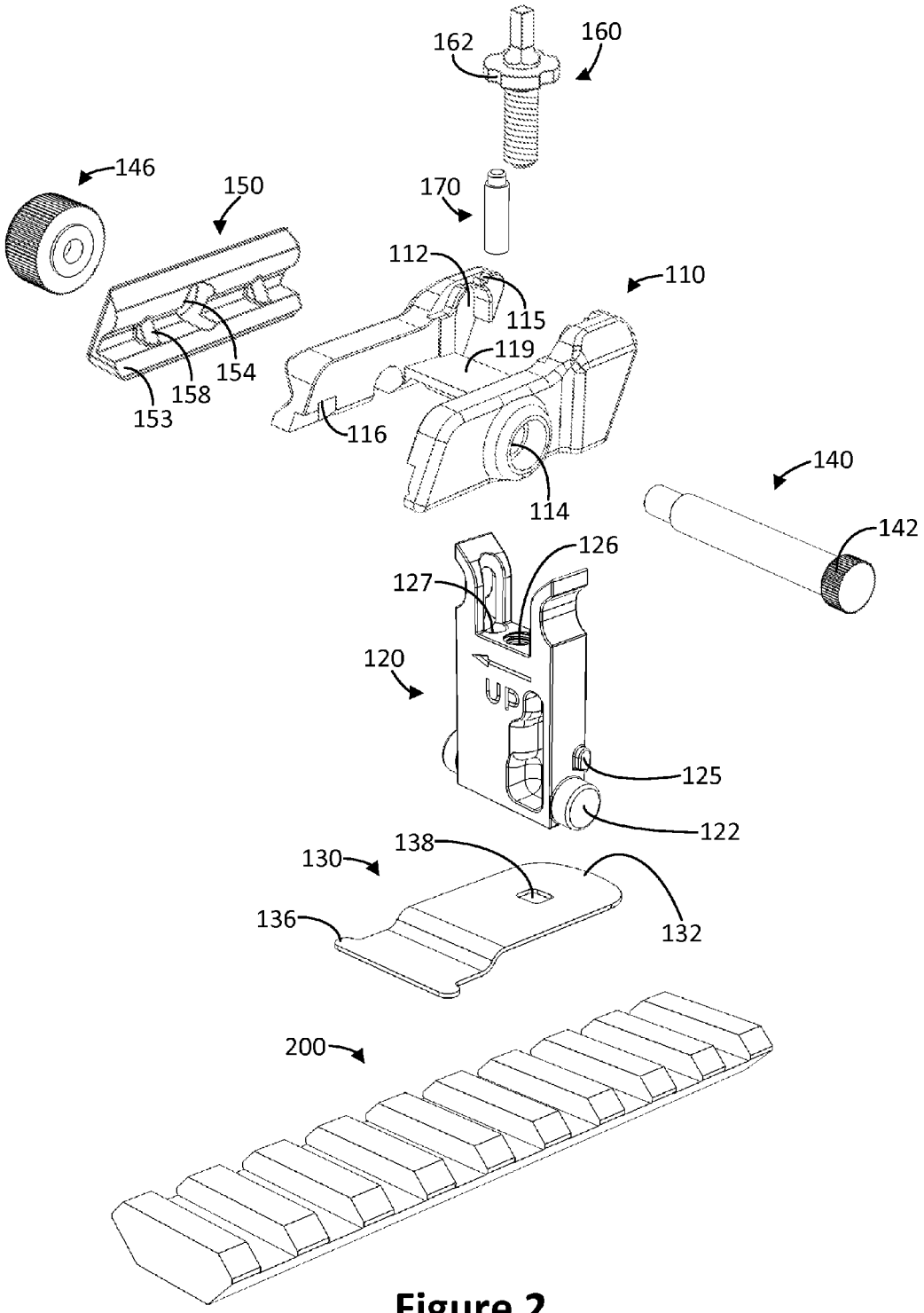
FIG. 2 illustrates an exploded view of the sight assembly and firearm rail shown in the embodiment of FIG. 1A.

FIGS. 1A and 1B illustrate front perspective views of a sight assembly 100 attached to a firearm rail 200 shown in a deployed and stowed position, respectively, in accordance with an embodiment of the present disclosure. FIG. 2 illustrates an exploded view of the sight assembly 100 and firearm rail 200 shown in the embodiment of FIG. 1A. Generally, sight assembly 100 in this embodiment includes a base 110, a sight arm 120, and a leaf spring 130. In this example embodiment, base 110 of the sight assembly 100 is configured to attach to the firearm rail 200 using a clamp bolt 140, clamp nut 146, and clamp bracket 150, as will be discussed in more detail below. As can also be seen, sight arm 120 in this example embodiment includes a sight post 160 and an alignment/locking pin 170. Note that sight post 160 and alignment/locking pin 170 are not shown in FIG. 1B to illustrate that such items can be removed from sight arm 120, as will be discussed in more detail below.

The firearm rail 200 shown in this embodiment is a Picatinny rail (also known as a MIL-STD-1913 rail, STANAG 2324 rail, tactical rail, or M1913) that may be used on a firearm to provide a standardized mounting platform for accessories and attachments, such as for attaching sight assembly 100 as shown in FIGS. 1A-B. In other embodiments, sight assembly 100 may be configured to attach to different firearm rails, such as a Weaver rail mount, NATO accessory rail (NAR) (also known as STANAG 4694), or any other suitable firearm rail or rail interface system (RIS) as will be apparent in light of this disclosure. As will also be apparent in light of this disclosure, sight assembly 100 as described herein may be used with any firearm including a rail or RIS. For example, sight assembly 100 may be used with various pistols (e.g., the P220® pistol), various rifles (e.g., the SIG516® rifle), and various machine/submachine guns (e.g., the SIG MPX™ submachine gun), just to name a few firearm examples (note that the specific firearm examples provided are all produced by Sig Sauer, Inc.). In some embodiments, the sight assembly as variously described herein may be configured to be integral with a firearm, such as integral with a firearm rail or firearm upper receiver, for example. Sight assembly 100 as described herein may also be used on replica firearms, such as airsoft guns, for example. Note that the sight assembly as variously disclosed herein is not intended to be limited for use with any particular firearm rail or RIS, or any particular firearm, unless otherwise indicated.

Figures 3A, 3B:
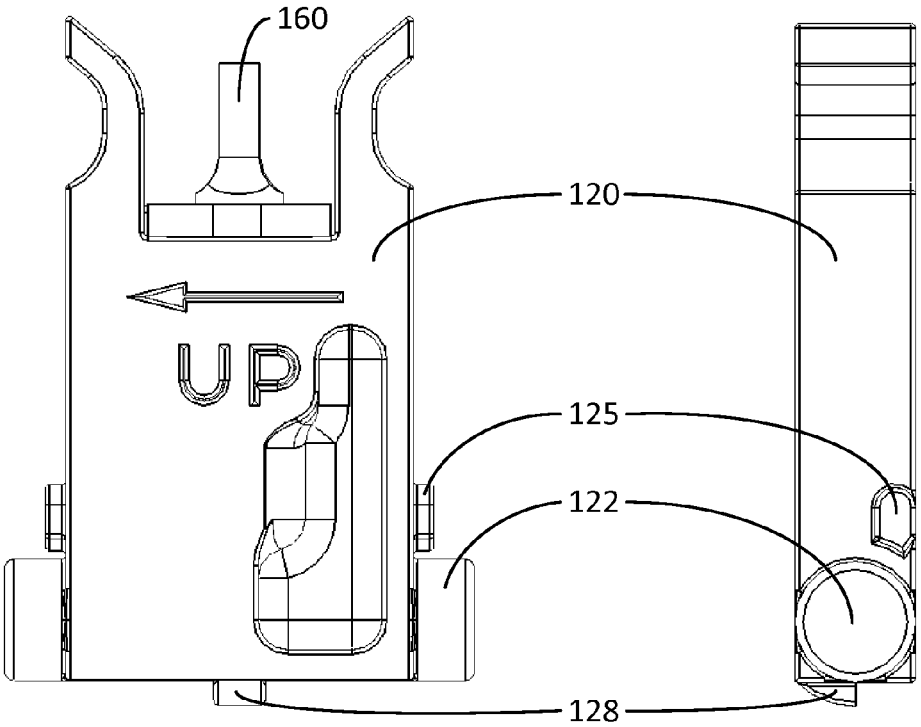
FIGS. 3A-B illustrate an example sight arm for a sight assembly configured in accordance with an embodiment of the present disclosure.

FIG. 2 illustrates how sight assembly 100 can be assembled and installed on firearm rail 200 in this particular embodiment. Sight arm 120 (also shown in FIGS. 3A-B) includes hubs or trunnions 122 and can be inserted from below into base 110 (also shown in FIG. 5A). When inserted, trunnions 122 nest in downward-facing pockets 112 on either side of base 110. The radius of pockets 112 may be equal to (or slightly greater than) the radius of trunnions 122, and pockets 112 may be open or half-moon shaped, for example, so that trunnions 122 can slide laterally into pockets 112. Thus, in some embodiments, pockets 112 may have geometry that complements trunnions 122. The trunnion-in-pocket coupling allows sight arm 120 to rotate about the axis of the trunnion relative to base 110 to allow a user, for example, to rotate sight arm 120 from the deployed position shown in FIG. 1A to the stowed position shown in FIG. 1B, and vice versa. Trunnions 122 can be primarily cylindrical (e.g., as shown in FIGS. 2 and 3*a-b*) or oval or some other suitable shape, and in some instances, can include flat portions that may secure the sight arm in stowed and/or deployed positions. In an example embodiment, the trunnions may have an elliptical shape configured to rotate relative to pockets 112 having geometry that is complementary to the elliptical trunnions, such that the trunnion/pocket configuration helps secure the sight arm in stowed and/or deployed positions. In other embodiments, the trunnion(s)

may be substantially cylindrical or elliptical but include one, two, or more flats that correspond to a flat (or flats) on the inner surface of pocket 112. The flat on the inner surface of pocket 112 may be at the highest vertical point in pocket 112. When the sight arm is in either a fully deployed or fully undeployed/stowed position, a flat on trunnion 122 can be in contact and aligned with a flat in pocket 112, the sight arm being maintained in this position by an upward force (e.g., a biasing force), such as from a leaf spring. In another example embodiment, the trunnions and pockets may include a post and notch system configured to help secure the sight arm in stowed and/or deployed positions. Sight arm 120 may be rotationally or pivotally coupled to base 110 in another suitable manner. For example, base 110 may include hubs that nest in upward-facing pockets in sight arm 120, or base 110 and sight arm 120 may both include pockets or bores that retain non-integral connecting hubs or posts that allow the two components to be rotationally coupled, just to name a few examples.

Sight arm 120 in this embodiment also includes post hole 126 and pin hole 127, which are configured to receive sight post 160 and alignment/locking pin 170, respectively. As shown in FIG. 2, sight post 160 and post hole 126 are threaded such that sight post 160 can screw into post hole 126. In other embodiments, the sight post may be coupled with the sight arm in another manner, such as a pressure/press or friction fit into the sight arm, for example. Alignment/locking pin 170 can be inserted into pin hole 127 before or after sight post 160 has been screwed into post hole 126 to help maintain the alignment of sight post 160 and/or lock sight post 160 into a desired position. For example, alignment/locking pin 170 may be inserted after sight pot 160 has been screwed into a desired location, such that the alignment/locking pin 170 fits within one of the notches 162 on sight post 160 (e.g., as can be seen in FIG. 1A). In another example configuration, alignment/locking pin 170 may be resiliently supported in the vertical direction (e.g., by a spring in pin hole 127), such that pin 170 can be depressed to allow rotation of sight post 160 past alignment/locking pin 170 and released to align and/or prevent rotation of sight post 160 relative to sight arm 120 after a desired position has been obtained. Note that alignment/locking pin 170 is optional and sight post 160 may be aligned and/or locked to sight arm 120 in another manner. For example, sight post 160 may be configured to press fit into sight arm 120 (and sight post 160 may be aligned upon insertion). In some such examples, sight arm 120 may be configured to receive sight posts of varying shapes and sizes (e.g., to adjust the height of the sight/reticle/aperture being used for sight arm 120). Sight arm 120 can also include tooth 128 and rotational stops 125, each of which may be used for aligning, positioning, and/or locking sight arm 120, which will be discussed in more detail below.

FIG. 3A illustrates a view of sight arm 120 that a user of a firearm may see when using this particular embodiment of sight assembly 100. As shown, sight post 160 provides a rectangular post in a generally rectangular space provided by the top of sight arm 120. As previously described, sight post 160 is removable and may be replaced by other sights/reticles, such as a ring, bead, or crosshair, just to name a few examples. In some embodiments, the sight arm may be configured with a notch (e.g., a U or V-notch) or aperture for use in an open sight configuration, such as a U-notch and post, a V-notch and bead, or a ghost rings configuration, for example. Therefore, sight assembly 100 may be used with another sight component to create a sight system (sometimes referred to as iron sights). In such cases, sight assembly 100 may be either the front component or the rear component of the sight system, or it may be both where two sight assemblies 100 are being used. For example, if one sight assembly 100 is used as a front sight, then it may include sight post 160, and if another sight assembly 100 is used as a rear sight, then it may include a sight notch or a sight aperture. Note that in some embodiments, the sight, notch, or reticle component of the sight arm may be a separate component configured to couple/attach to the sight arm (such as is the case with sight post 160 and sight arm 120), while in other embodiments, such a component may be integral with the sight arm.

Figures 4A, 4B:
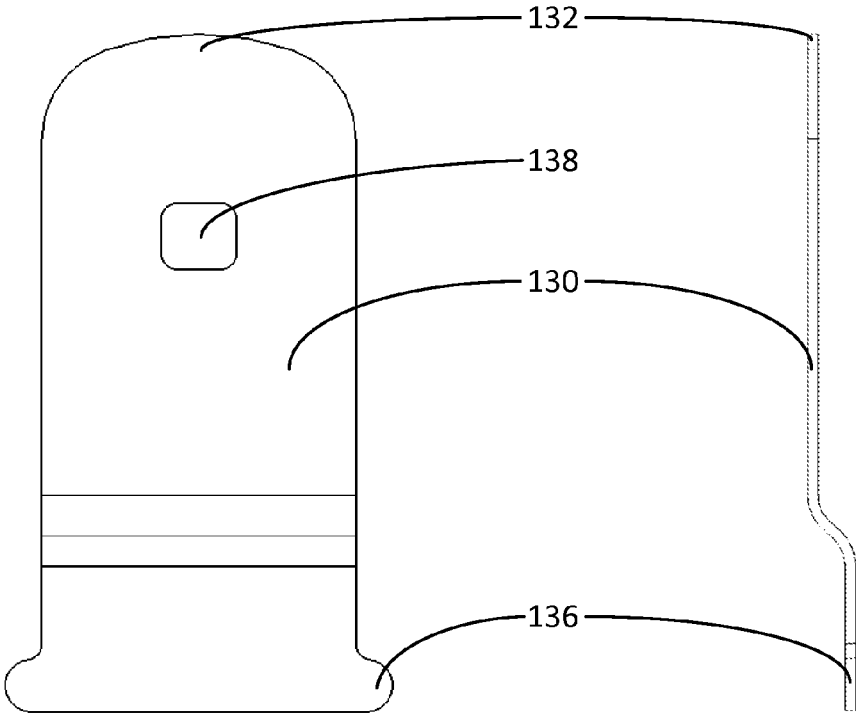
FIGS. 4A-B illustrate an example leaf spring for a sight assembly configured in accordance with an embodiment of the present disclosure.

Once sight arm 120 is inserted into base 110 as previously described, leaf spring 130 (also shown in FIGS. 4A-B) can be inserted or positioned between sight arm 120 and base 110. Note that leaf spring 130 may also be assembled with base 110 prior to assembling sight arm 120 with base 110, as will be apparent in light of this disclosure. Leaf spring tabs 136 on either side of leaf spring 130 fit into pockets 116 on either side of base 110 to help position and secure leaf spring 130 in sight assembly 100 (e.g., as can be seen in FIG. 1A). Clamp bolt 140 can be inserted through base hole 114 while deflecting the middle of leaf spring 130 until clamp bolt head 142 is fully inserted into the base hole (e.g., as shown in FIG. 1A). In addition, the end portion 144 of clamp bolt 140 can be inserted through clamp bracket 150 (also shown in FIG. 5B) and then clamp nut 146 can be screwed onto end portion 144 to clamp the bracket 150 and base 110 together and secure the assembly (e.g., to rail 200). In this manner, clamp bolt 140 can act as a fulcrum for leaf spring 130 (and force tabs 136 into pockets 116), as will be discussed in more detail below. Note that clamp bolt 140 may be assembled with base 110 prior to assembling leaf spring 130 with base 110, as will be apparent in light of this disclosure. Also note that when sight assembly 100 is assembled, leaf spring 130 and clamp bolt 140 are used to capture sight arm 120 in a hinged arrangement with base 110.

The particular order of assembly as described herein is provided as one example for assembling sight assembly 100; however, sight assembly 100 may be assembled in another suitable manner. For example, leaf spring 130 may first be combined with base 110 and then sight arm 120 can be inserted into base 110 by deflecting end 132 of leaf spring 130 downward. Further the shapes and sizes of the components of sight assembly 100 may vary between embodiments. For example, the size and shape of base 110 may be selected based on the particular firearm rail for which it is intended. The components of sight assembly 100 (e.g., base 110, sight arm 120, leaf spring 130, etc.) can be constructed from any suitable material, such as various metals (e.g., aluminum, steel, or any other suitable metal or metal alloy material) or plastics (e.g., polymers, such as polystyrene, polycarbonate, and polypropylene, or any other suitable polymer or plastic material). In an example embodiment, base 110, sight arm 120, and leaf spring 130 are all constructed from MIM 4650 low alloy steel.

In some cases, the dimensions of the sight assembly components may be selected based on the overall desired height, length, and/or width of the sight assembly, while in other cases, the overall height, length, and/or width of the sight assembly may be selected based on the desired dimensions of the sight assembly components. For example, the height of sight arm 120 may be selected to minimize the maximum overall height of sight assembly 100 (in the deployed position), since sight arm 120 accounts for a substantial portion of the height of sight assembly 100.

Specifically, sight arm 120 may be configured to have a height of 1, 2, 3, 4, 5, 7.5, or 10 cm, or some other suitable height to allow for a small form factor for sight assembly 100 (e.g., less than 3, 4, 5, 6, 7, 9.5, or 12 cm where the base adds 2 cm to the overall height). Further, sight arm 120 may be configured to have a length of 1, 2, 3, 4, 5, 7.5, or 10 cm, or some other suitable length to allow for a small form factor for sight assembly 100 (e.g., less than 2, 3, 4, 5, 6, 8.5, or 11 cm where the end 132 of leaf spring 130 adds 1 cm to the overall length). In some instances, the maximum overall height or length of sight assembly 100 (in the deployed position) may be selected relative to the overall height of sight arm 120. For example, the overall length of sight assembly 100 may be selected to be less than 100%, 110%, 120%, or 150% of the overall height of sight arm 120. In some instances, the dimensions of the sight assembly and/or one or more of its components may be selected based on the firearm rail or firearm it is intended to be used with.

Figure 5A:
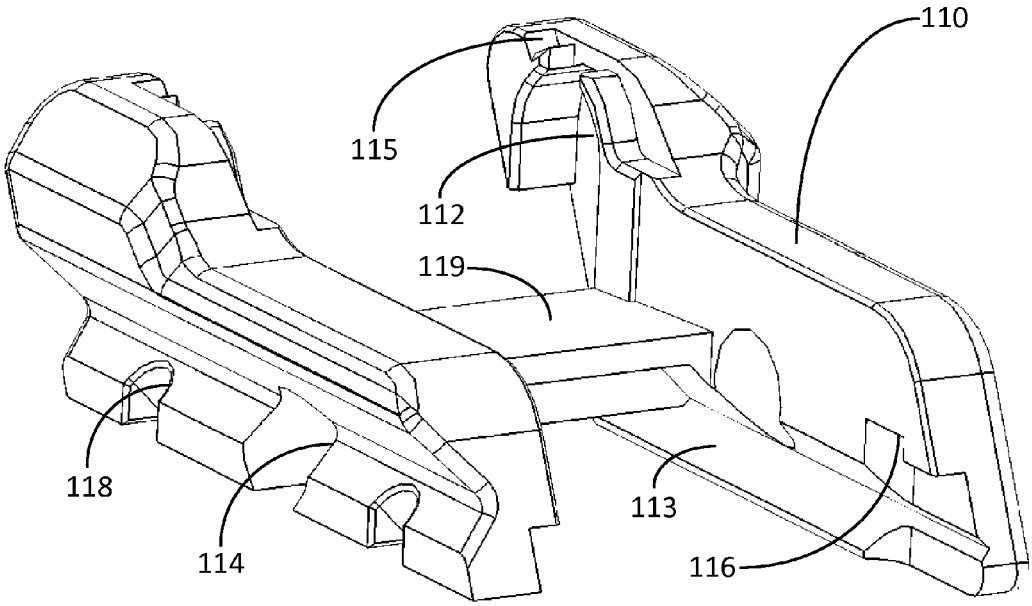
FIG. 5A illustrates an example base for a sight assembly configured in accordance with an embodiment of the present disclosure.
Figure 5B:
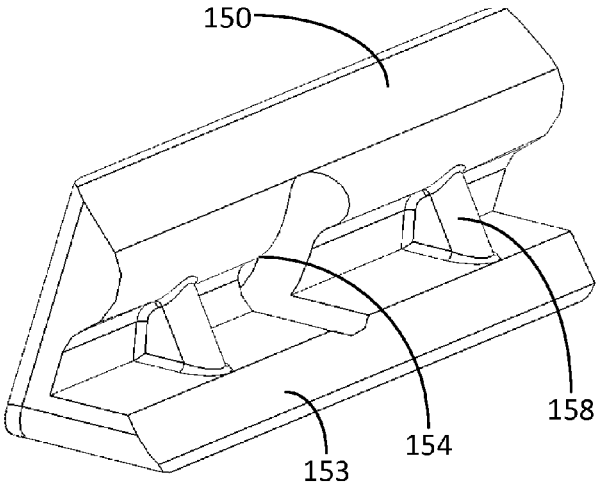
FIG. 5B illustrates an example clamp bracket for a sight assembly configured in accordance with an embodiment of the present disclosure.
Figure 6:
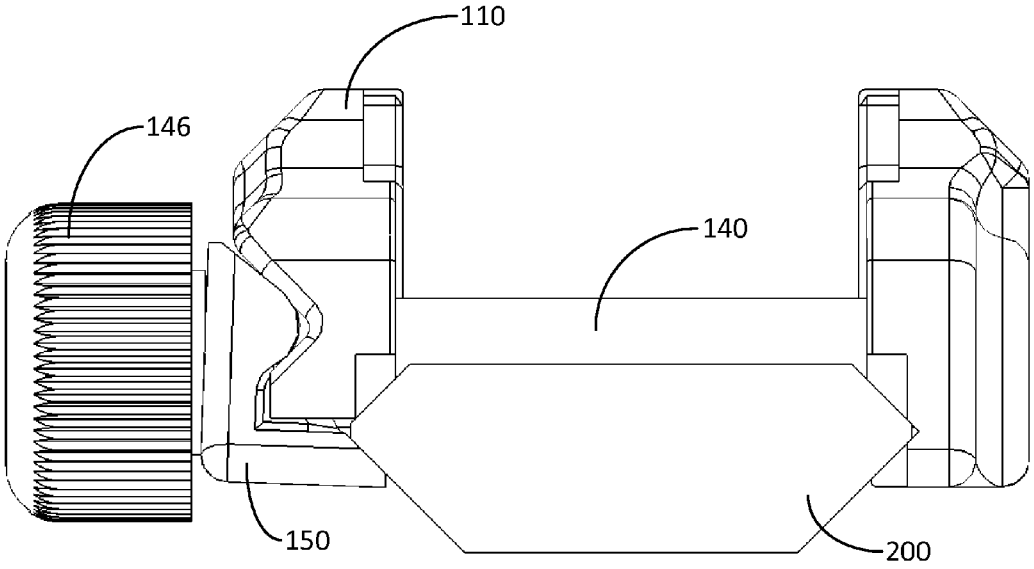
FIG. 6 illustrates an example base of a sight assembly attached to a firearm rail configured in accordance with an embodiment of the present disclosure.

FIG. 6 illustrates base 110 of sight assembly 100 attached to firearm rail 200, in accordance with an embodiment of the present disclosure. As shown in FIG. 6, base 110 can be clamped to firearm rail 200 using the clamp bolt 140, clamp nut 146, and clamp bracket 150 system as can be seen in this embodiment. More specifically, clamp bracket 150 includes alignment fins 158 that match up with cutaways 118 in base 110, as can be seen in FIGS. 5A-B. This ensures that clamp holes 114 and 154 when bracket 150 and base 110 are clamped together using clamp bolt 140. In this embodiment, clamp nut 146 may be loosened to allow clamp bracket 150 to be loosened from base 110, which may allow sight assembly 100 to be attached to firearm rail 200 without having to fully remove clamp nut 146 from clamp bolt 140. For example, after loosening clamp nut 146, base 110 and clamp bracket 150 may be slid onto firearm rail 200 from the front or back of the rail, or over the top of the rail, to eventually secure base 110 to rail 200 at a desired location (e.g., by tightening clamp nut 146). In addition, loosening clamp nut 146 may allow a user to slide sight assembly 100 to the desired position on firearm rail 200 while slidably maintaining the sight assembly on the rail, until the desired position is reached, allowing the user to tighten clamp nut 146, thereby tightening clamp bracket 150 to base 110 and securing sight assembly 100 to firearm rail 200.

In some embodiments, the base of the sight assembly may be attached in another manner, such as using one or more set screws, using a spring clamp system, or using any other suitable system as will be apparent in light of this disclosure. Further, firearm rail 200 shown in FIG. 6 is a Picatinny rail, and therefore base 110 and clamp bracket 150 are configured to attach to that specific rail. More specifically, edge 113 of base 110 and edge 153 of clamp bracket 150 are designed with a 45 degree angle to match the angle of the bottom of the Picatinny rail to provide a suitable fit. However, in other embodiments, the base and/or its attachment system may be configured to attach to one or more different rails or rail interface systems. In some embodiments, the base of the sight assembly may be integral with a firearm or a component of a firearm. In such embodiments, the base may be designed to be integral with the rail or upper receiver of a firearm, for example, such that the remaining components of sight assembly 100 as variously described herein can be installed and assembled onto the base which is integral with the firearm. Further, in such embodiments, various components of sight assembly 100 may be configured to be compatible with the base depending on the design or application of the sight assembly. For example, arm 120 of sight assembly 100 may be configured to attach to the base in any suitable manner, using any suitable techniques, to accommodate for embodiments where the base is integral with a firearm or firearm component. A specific example configuration may include a base integral to the firearm rail or firearm upper receiver, where the base has enough clearance to slide trunnions 122 of arm 120 into pockets 112 of the integral base. Another specific example configuration may include utilizing an arm similar to arm 120, where one or both trunnions 122 may be spring-loaded to allow for the trunnion(s) to be depressed into the main body of the arm, allowing the trunnions to clear the walls of the integral base that form pockets 112, thereby allowing the trunnions to be placed in pockets 112. In such an example configuration, the arm may be further configured with a device for depressing the spring-loaded trunnion(s) when the trunnions are located in pockets 112 to allow for removal of the arm from the base, such as a pin connected to the trunnion(s) and extending through the arm allowing a user to depress a trunnion without having to directly press the trunnion. It is to be understood that the trunnion and pocket combination is provided for illustrative purposes and is not intended to limit the present disclosure.

Figure 7:
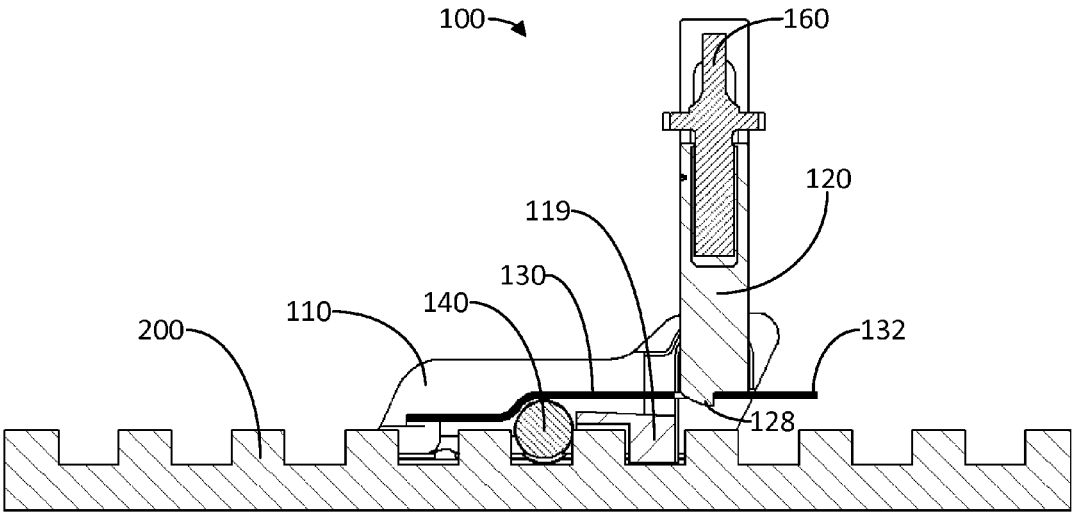
FIG. 7 illustrates a cross-sectional view of the sight assembly and firearm rail shown in the embodiment of FIG. 1A, along line A-A.

FIG. 7 illustrates a cross-sectional view of the sight assembly 100 and firearm rail 200 shown in the embodiment of FIG. 1A, along line A-A. As can be seen, clamp bolt 140 acts as a fulcrum for leaf spring 130 in this example embodiment. When leaf spring 130 is positioned between base 110 and sight arm 120, it may be deflected by sight arm 120 and may therefore be placed under compression. When leaf spring 130 is deflected, it provides a biasing force in an upward vertical direction against sight arm 120, as will be discussed in more detail below. Also note that when leaf spring 130 is deflected, tabs 136 (e.g., as shown in FIG. 2) are forced in an upward vertical direction into pockets 116 of base 110. In other embodiments, other components of the sight assembly may act as a fulcrum for the leaf spring. For example, in an embodiment, a portion of the base may act as a fulcrum for the leaf spring. Using the example embodiment shown in FIG. 7, connecting portion 119 of base 110 may act as a fulcrum for a leaf spring in a sight assembly using a leaf spring having a different shape than the leaf spring 130 shown. In another example embodiment, clamp bolt 140 may be integral to base 110, and may act as a fulcrum for the leaf spring.

As can also be seen in FIG. 7, a tooth 128 located on the bottom of sight arm 120 has been inserted into an aperture 138 in leaf spring 130. The insertion can occur when sight arm 120 is unfolded away from the base into a deployed position as shown in FIGS. 1A and 7 (as compared to the stowed position shown in FIG. 1B). In this manner, aperture 138 helps align and lock sight arm 120, and also helps to provide a horizontal positional reference for sight arm 120 (e.g., to help horizontally align and/or lock sight arm 120 relative to base 110). Tooth 128 (which may be any suitable post, protrusion, etc.) on the bottom of sight arm 120 engages aperture 138 (which may also be any suitable hole, bore, notch, slit, groove, etc.), blocking any meaningful rotation towards the stowed position, while rotational stops 125 prevent meaningful rotation in the opposite direction by coming into contact with base stops 115 (e.g., as can be seen in FIG. 1A). Note that the side of tooth 128 that first makes contact with leaf spring 130 (when unfolding sight arm 120 to a deployed position) is curved to allow tooth 128 to slide over and depress leaf spring 130 as sight arm 120 is deployed until the straight edge of tooth 128 enters aperture 138 and snaps into the locked, deployed position. Also note that tooth 128 may be configured to fill aperture 138 to help avoid any movement of sight arm 120 after locking into the deployed position. Sight arm 120 is locked in the deployed position until the release end 132 of leaf spring 130 is depressed to allow the straight edge of tooth 128 to clear leaf spring 130, which allows sight arm 120 to be folded toward the base to the stowed position.

In some embodiments, the sight arm may include an additional tooth that locks the sight arm into a stowed position. For example, such a tooth may be located on the viewable face of the sight arm seen in FIG. 3A, such that when the sight arm is rotated or folded toward the base to a stowed position, the tooth engages aperture 138 in a manner similar to the way that tooth 128 engages aperture 138 when sight arm 120 is being rotated to a deployed position, as described above. In other embodiments, the sight arm may include one or more apertures, grooves, bores, or holes that receive a tooth (or other suitable post, protrusion, etc.) located on the leaf spring. Therefore, in one or more embodiments, the sight arm and leaf spring may include various locking means configured to lock the sight arm in a stowed and/or deployed position. In such embodiments, the locking means may be integral or incorporated into the sight arm and/or leaf spring, such that locking the sight arm in a deployed and/or stowed position can be achieved without independent locking mechanisms. In yet other embodiments, the sight arm may not include any teeth, and the biasing force of the leaf spring on the sight arm may provide for a detented-only sight arm. In other words, the sight arm may be held in the deployed and stowed positions only by the biasing force of the leaf spring on the sight arm, such that the sight arm can be folded/rotated in a desired direction without performing any other action (e.g., without first depressing/releasing the leaf spring). The spring constant of the leaf spring and/or the pre-deflection/compression on the spring in the assembly may be adjusted to increase or reduce the amount of biasing force applied by the leaf spring on the sight arm. For example, the spring constant may be adjusted based on the shape or material of the leaf spring used, and the pre-deflection/compression on the leaf spring may be adjusted by changing the contact location(s) of either end of the leaf spring (e.g., reduce the depth of pockets 116 to increase pre-deflection/compression or increase the depth of pockets 116 to decrease the pre-deflection/compression, etc.), just to name a few examples.

Figure 8A:
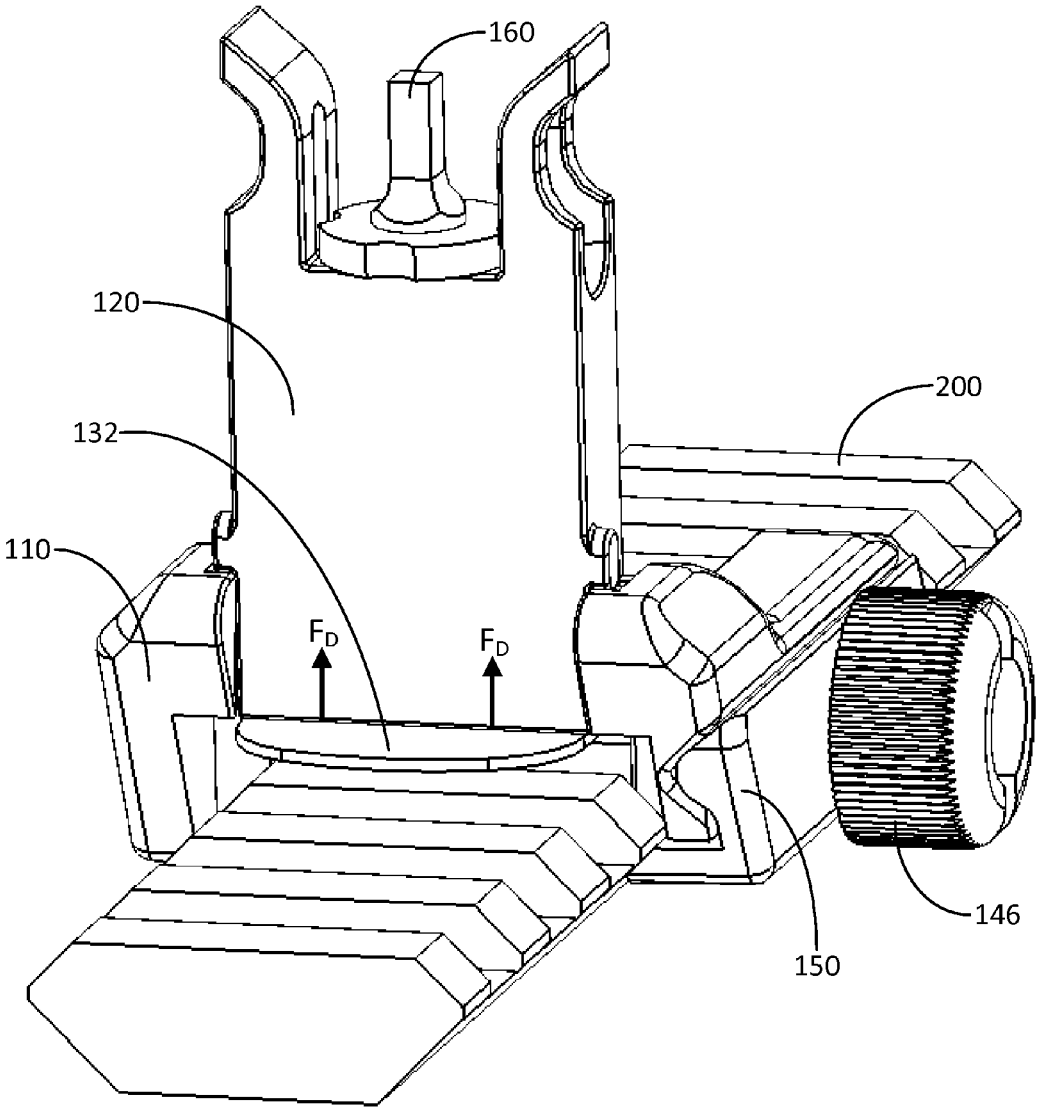
FIGS. 8A-B illustrate example biasing forces applied by a leaf spring on a sight arm in a deployed and stowed position, respectively, in accordance with an embodiment of the present disclosure.
Figure 8B:
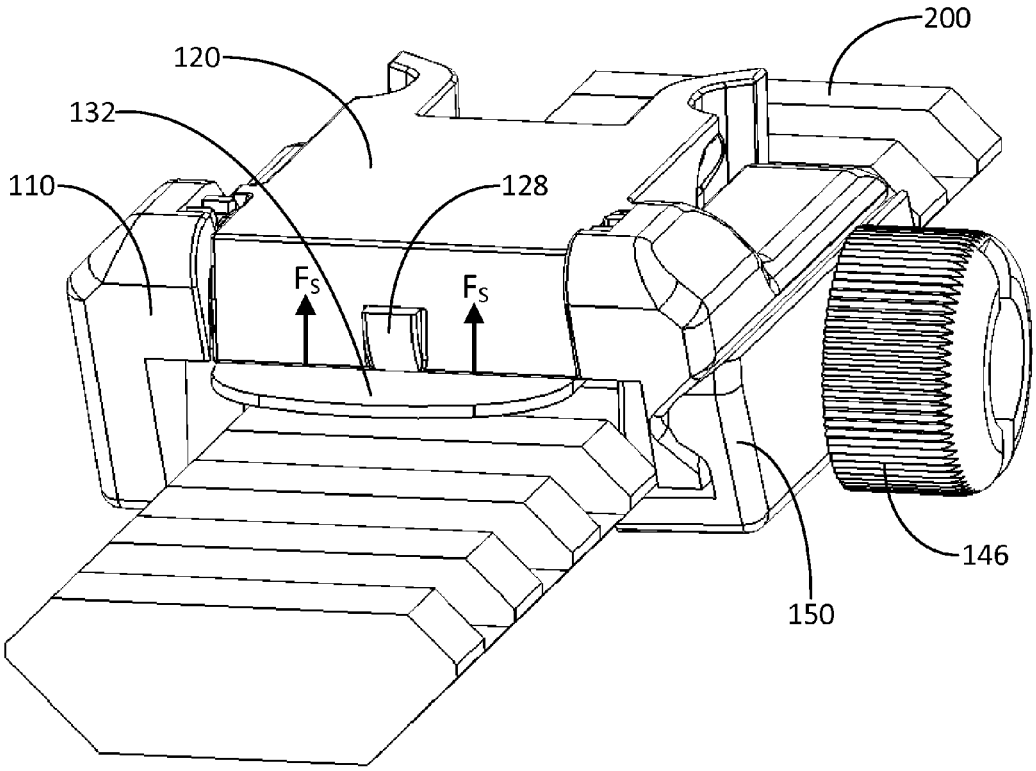

FIGS. 8A-B illustrate example biasing forces applied by leaf spring 130 on sight arm 120 in a deployed and stowed position, respectively, in accordance with an embodiment of the present disclosure. As can be seen in FIG. 8A, leaf spring 130 is applying a biasing force $F_D$ on the bottom of sight arm 120 when in a deployed position. Biasing force $F_D$ helps to resist rotation in the direction of the stowed position, by applying a torque load on the bottom edge of sight arm 120 (i.e., the bottom edge making contact with leaf spring 130 as shown in FIG. 8A) and thereby reducing the ability to rotate sight arm 120, for example. As can be seen in FIG. 8B, leaf spring 130 is applying a biasing force $F_S$ on the face of sight arm 120 (i.e., the face/edge making contact with leaf spring 130 as shown in FIG. 8B) when in a stowed position. In this manner, the biasing force applied to sight arm 120 by leaf spring 130 helps cause sight arm 120 to preferably achieve either the deployed or stowed (undeployed) position. In other words, as sight arm 120 is rotated toward the deployed position, leaf spring 130 is first deflected downward by a broad corner of sight arm 120, and then by tooth 128 on the bottom of sight arm 120.

When, through rotation of sight arm 120 from either the stowed or deployed position, sight arm 120 contacts leaf spring 130 substantially at a corner of sight arm 120, then the force applied by leaf spring 130 at the point of contact represents a torque load applied to sight arm 120 roughly equal to the force times the distance between the normal vector and the axis of trunnions 122. Therefore, as sight arm 120 is purposefully moved away from the stowed position, it immediately encounters a torque load which would otherwise serve to hold sight arm 120 in place. As rotation of sight arm 120 continues, the normal vector approaches, then passes through, the axis of trunnions 122. This then corresponds to a diminished torque load on sight arm 120. As rotation is continued, and the normal vector moves away from the axis of trunnions 122, the torque load returns, but now in a direction which biases sight arm 120 towards the deployed position.

When through continued rotation sight arm 120 contacts leaf spring 130 across the flat surface adjacent to the corner, then forces are present on either side of the axis of trunnions 122. These forces may be allowed to balance, holding sight arm 120 at rest. Similar action occurs whether rotating sight arm 120 from the deployed position (e.g., as shown in FIG. 8A) or from the stowed position (e.g., as shown in FIG. 8B). When the leaf spring force is allowed to balance across the bottom of sight arm 120 in the deployed position, leaf spring 130 may be used as a robust positional reference, returning sight arm 120 to the same position whenever it is moved away slightly by either the motion of the firearm through the act of firing, or by chance contact with surroundings. This can eliminate sources of sighting error that would otherwise be associated with folding sights.

As the deployed position is reached, tooth 128 is brought into alignment with aperture 138 in the deflected leaf spring 130, allowing leaf spring 130 to snap upward and bear fully against the bottom surface of sight arm 120, providing a biasing force against rotation in either direction (e.g., until a user overcomes the biasing force to manually rotates sight arm 120). However, if tooth 128 does not reach aperture 138, sight assembly 100 is configured such that the biasing force applied to the bottom of sight arm 120 when sight arm is in an intermediate position (i.e., neither deployed nor stowed) would cause sight arm 120 to return to the stowed position. Therefore, in some embodiments, tooth 128 may not be included and the biasing force of the leaf spring on the bottom of the sight arm may provide for a detented-only sight arm, as previously described.

As used herein, "integral" means that two components are attached and formed from a common part or are otherwise affixed together in such a way that they cannot be separated without damaging one or more of the components. For example, in some embodiments, the sight assembly base may be integral with a firearm component (e.g., a firearm rail, a firearm upper receiver, etc.), such that the base cannot be separated from the firearm component without materially damaging at least one of the base and the firearm component.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A firearm sight assembly comprising:

a base configured to attach to a firearm rail;

a sight arm rotationally coupled to the base; and a leaf spring positioned between the base and the sight arm;

wherein the leaf spring provides a biasing force to the sight arm in a direction substantially away from the base; and wherein the leaf spring defines an aperture and the sight arm includes at least one tooth configured to insert into the leaf spring aperture to lock the sight arm in a stowed and/or deployed position.

2. The assembly of claim 1, wherein the leaf spring acts as a detent to resist the rotation of the sight arm.

3. The assembly of claim 1, wherein the sight arm includes trunnions configured to nest in pockets on sides of the base.

4. The assembly of claim 1, wherein the base includes hubs configured to nest in pockets in the sides of the sight arm.

5. The assembly of claim 1, wherein the leaf spring extends beyond at least one end of the sight arm to allow an end of the leaf spring to be manually depressed to unlock the sight arm when locked in the stowed and/or deployed position.

6. The assembly of claim 1, wherein the leaf spring includes tabs on an end of the leaf spring, the tabs configured to be placed in and provide force against pockets in the base.

7. The assembly of claim 1, wherein a portion of the base acts as a fulcrum for the leaf spring.

8. The assembly of claim 1, wherein the maximum overall height of the assembly is less than 5 cm when in the deployed position.

9. The assembly of claim 1, wherein the overall length of the assembly is less than 120% of the overall height of the sight arm.

10. The assembly of claim 1, wherein the sight arm includes a removable sight post.

11. The assembly of claim 1, wherein the sight arm and/or the base include rotational stops to resist rotation of the sight arm relative to the base in at least one direction once the sight arm is in the deployed position.

12. A foldable firearm sight assembly comprising:

a base configured to attach to a firearm rail;

a clamp bracket configured to fix the base to the firearm rail;

a clamp bolt connecting the clamp bracket to the base;

a sight arm rotationally coupled to the base at a pivot point; and a leaf spring positioned between the base and the sight arm;

wherein the clamp bolt acts as a fulcrum for the leaf spring; and wherein one of the sight arm and the leaf spring includes at least one of an aperture, hole, bore, notch, slit, and groove and the other of the sight arm and the leaf spring includes at least one of a tooth, post, and protrusion configured to engage with the at least one of an aperture, hole, bore, notch, slit, and groove to lock the sight arm in a stowed and/or deployed position.

13. The assembly of claim 12, wherein the aperture is defined in one of the sight arm and the leaf spring and the tooth is on the other of the sight arm and the leaf spring, the tooth configured to insert into the aperture when the sight arm is in a stowed and/or deployed position.

14. The assembly of claim 12, wherein the leaf spring provides a biasing force to the sight arm.

15. The assembly of claim 12, wherein the leaf spring extends beyond at least one end of the sight arm to allow an end of the leaf spring to be manually depressed to unlock the sight arm when locked in the stowed and/or deployed position.

16. A method of unlocking a firearm sight assembly, the firearm sight assembly including a base, a sight arm rotationally coupled to the base, and a leaf spring positioned between the base and the sight arm, wherein the sight arm and leaf spring are configured to lock the sight arm in a stowed and/or deployed position, the method comprising:

depressing an end of the leaf spring to clear the sight arm from the leaf spring;

pivoting the sight arm to a new position; and releasing the end of the leaf spring.

17. The method of claim 16, wherein the end of the leaf spring extends beyond at least one end of the sight arm.

18. The method of claim 16, wherein the end of the leaf spring extends beyond at least one end of the base.

19. The method of claim 16, wherein at least one aperture is defined in one of the sight arm and the leaf spring and a tooth is on the other of the sight arm and the leaf spring, and wherein the tooth is configured to insert into the at least one aperture when the sight arm is in a stowed and/or deployed position.

20. The method of claim 16, wherein the base is configured to attach to a firearm rail.

21. The method of claim 16, wherein the base is integral with at least one of a firearm and a component removably attached to the firearm.

* * * * *